United States Patent [19]

Jann

[11] Patent Number: 4,903,930

[45] Date of Patent: Feb. 27, 1990

[54] CHAIR HEIGHT ADJUSTMENT MECHANISM

[76] Inventor: James M. Jann, 1650 Glen Forest, Ada, Mich. 49301

[21] Appl. No.: 267,386

[22] Filed: Nov. 4, 1988

[51] Int. Cl.[4] ..... F16M 11/00

[52] U.S. Cl. ..... 248/406.2; 248/188.2

[58] Field of Search ..... 248/406.2, 406.1, 188.2

[56] References Cited

U.S. PATENT DOCUMENTS

| | | | |
|---|---|---|---|
| 249,991 | 11/1881 | Ramseyer | 248/406.1 |
| 2,010,292 | 8/1935 | Campbell . | |
| 2,058,451 | 10/1936 | Herold . | |
| 2,529,861 | 11/1950 | Angell et al. . | |
| 3,799,485 | 3/1974 | Wolters . | |
| 3,799,486 | 3/1974 | Mohr et al. . | |
| 3,856,253 | 12/1974 | Seebinger . | |
| 4,324,382 | 4/1982 | Beukema et al. | 248/406.2 |
| 4,379,540 | 4/1983 | French . | |
| 4,394,001 | 7/1983 | Wisniewski | 248/406.2 X |
| 4,440,372 | 4/1984 | Wisniewski | 248/406.2 |
| 4,494,721 | 1/1985 | Trinkel et al. | 248/406.2 |
| 4,540,148 | 9/1985 | Jann | 248/406.2 |
| 4,598,892 | 7/1986 | Franckowlak et al. | 248/406.2 |
| 4,627,602 | 12/1986 | Sporck | 248/161 X |

*Primary Examiner*—Alvin C. Chin-Shue
*Assistant Examiner*—David L. Talbott
*Attorney, Agent, or Firm*—Waters, Morse & Harrington

[57] ABSTRACT

This chair height adjustment mechanism has a tubular housing fixed to the chair base, with vertically-spaced bearings providing lateral support for a threaded spindle secured to the chair seat. The upper bearing permits the spindle to move axially, and a nut in threaded engagement with the spindle below the upper bearing is biased upward into clutch engagement with the lower end of this bearing. The biasing spring acts between washers keyed to the spindle, the lower of these being supported by the upper face of the lower spindle bearing. Weight on the seat moves the spindle downward against the spring action to disengage the nut so it can rotate with the spindle, thus removing any change in the height adjustment of the chair when it is occupied.

22 Claims, 5 Drawing Sheets

CHAIR HEIGHT ADJUSTMENT MECHANISM

BACKGROUND OF THE INVENTION

One of the common arrangements for adjusting the height of the seat of a chair is to mount the seat on a threaded spindle that engages a nut that is rotatably fixed with respect to the base of the chair when no weight is present on the seat. Rotation of the seat in either direction then raises or lowers it according to the direction of rotation. Placement of weight on the seat disengages a clutch mechanism that leaves the nut free to turn with the spindle as the occupant of the seat turns to face in different directions.

These mechanisms have tended to be somewhat difficult and expensive to manufacture. They can best be functionally compared on the basis of (a) the vertical distance between the bearings supporting the spindle, (b) the closeness of the upper bearing to the seat of the chair, (c) the least extent of the "stick-out" of the spindle at the downward extent of the adjustment for a given degree of adjustability and bearing spacing, and (d) the total amount of vertical adjustment or "stroke" allowed within comparable envelopes. The vertical distance between the bearings supporting the spindle against lateral forces has a significant effect on the wear characteristics of the mechanism, and the closeness of the upper bearing to the seat has an effect on the leverage of the lateral forces as they are applied. The present invention provides a simplified structure with regard to the cost of component parts and the assembly procedures, while retaining a combination of the desirable features listed above.

SUMMARY OF THE INVENTION

A tubular housing fixed to the base of the chair has an upper section of expanded diameter providing a chamber containing the clutch mechanism. A shoulder at the bottom of the chamber functions as a support for the lower spindle bearing in one form of the invention. In a modified form of the invention, the material forming the shoulder itself becomes the bearing. The upper bearing for the spindle closes the top of the housing, and positions the spindle laterally while allowing it to move freely axially. The adjustment nut is directly below the upper bearing, and is biased upwardly against the lower transverse face of this bearing to form a clutch. Downward movement of the spindle in response to the presence of weight on the seat compresses the biasing spring, and releases the nut to turn with the spindle. Spring washers keyed to the spindle bear against the lower spindle bearing and against the underside of the nut for axial thrust transfer.

DESCRIPTION OF THE PREFERRED EMBODIMENT

Figure 1:
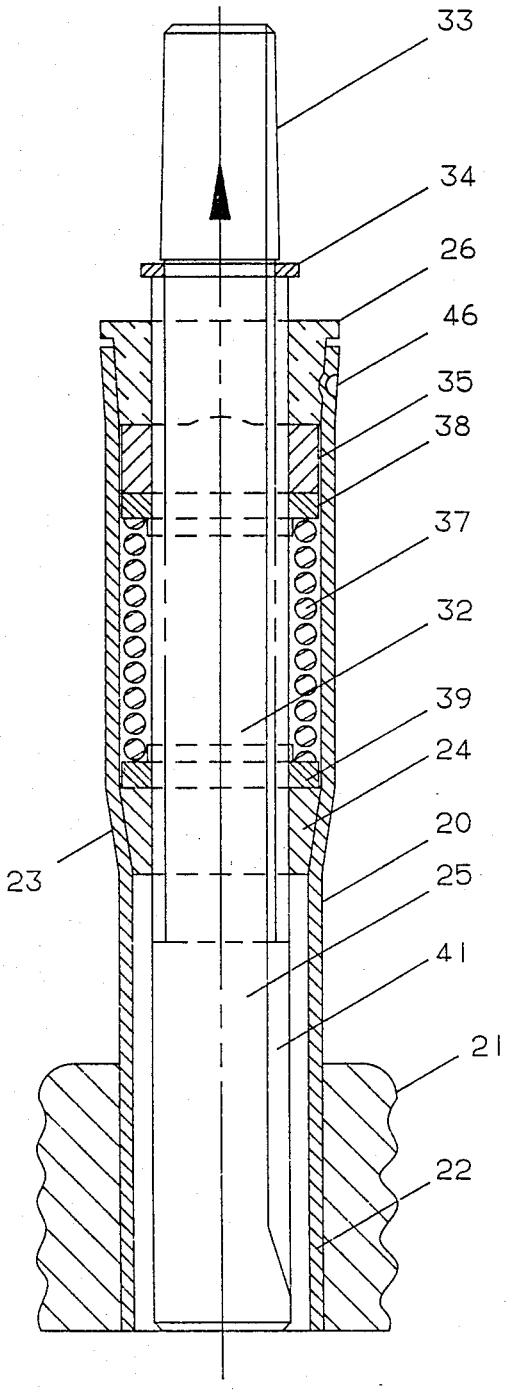
FIG. 1 is an axial section of the adjustment mechanism in a condition corresponding to the absence of weight on the seat of the chair.
Figure 2:
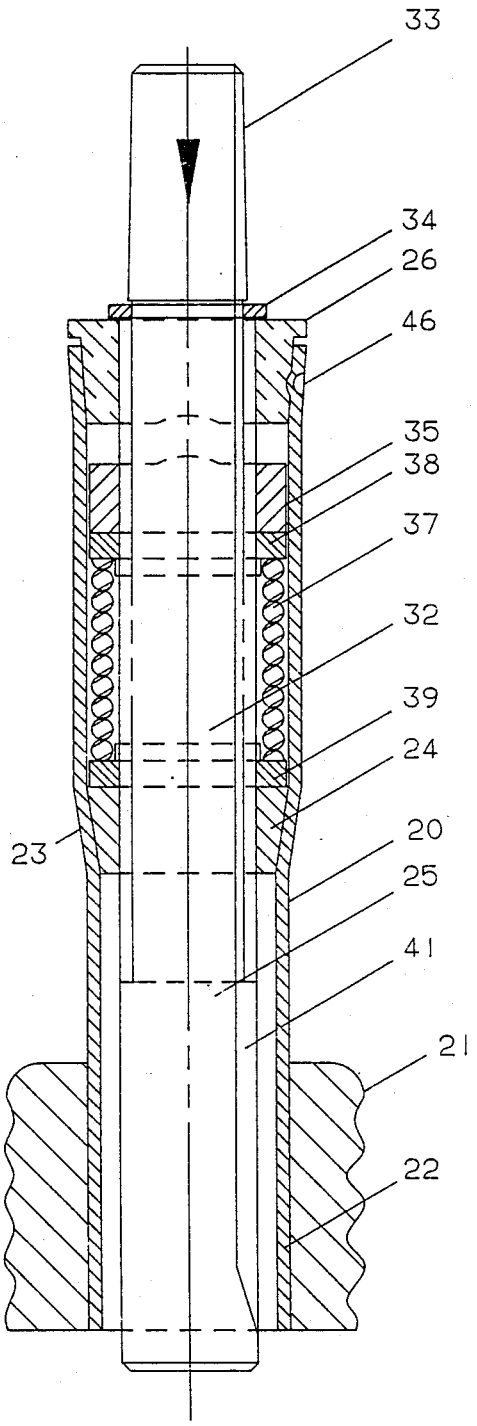
FIG. 2 is a section similar to FIG. 1, but in a condition corresponding to the presence of weight on the seat.

Referring to the drawings, the tubular steel housing 20, as shown in FIGS. 1 and 2, is fixed with respect to the base 21. This base is conventional, and represents the central area at the intersection of a group of radially-extending legs provided with casters. The lower extremity of the housing indicated at 22 is provided with a slight swaged taper of one (1) degree, eight (8) minutes, and forty-six (46) seconds per side to provide a solid forced-fit engagement of the mechanism to various standard chair bases. The tubular steel column in FIGS. 1 and 2 is constructed as what is known in the industry as a forty (40) millimeter taper. The measurement refers to the outside diameter of the tubular steel column which is compatible with the dimensional requirements for many of the office chair bases manufactured in the United States. As will be discussed further, there are other size conventions within the industry, none of which represent a limitation of the present invention.

Figure 3:
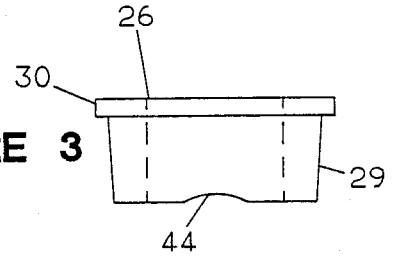
FIG. 3 is a side elevation of the upper bearing.
Figure 5:
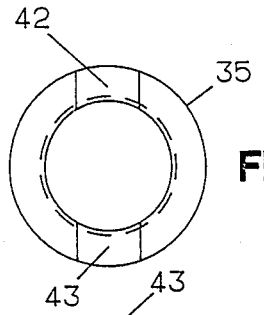
FIG. 5 is a top view of the adjustment nut.
Figure 6:
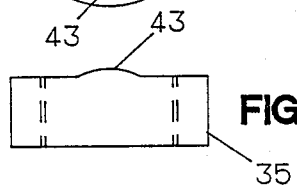
FIG. 6 is a side elevation with respect to FIG. 5.
Figure 4:
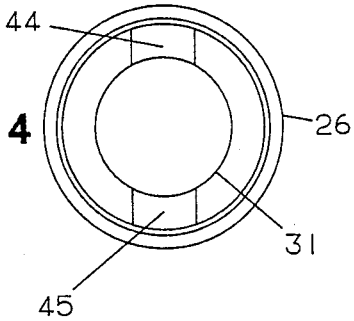
FIG. 4 is a bottom view with respect to FIG. 3.
Figure 9:
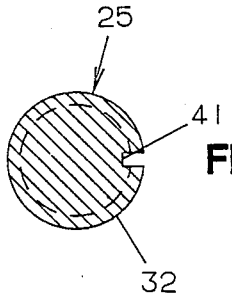
FIG. 9 is a sectional view through the threaded portion of the spindle.
Figure 10:
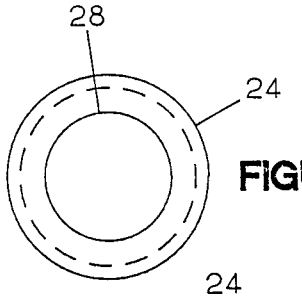
FIG. 10 is a top view of the lower bearing.
Figure 11:
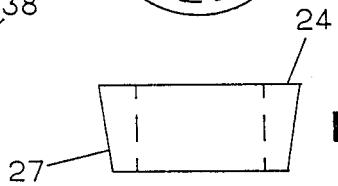
FIG. 11 is a side elevation with respect to FIG. 10.

The central portion of the housing 20 has a tapered expansion of diameter indicated at 23 providing a wedging shoulder for supporting the lower spindle bearing 24. The upper portion of the spindle 25 is supported by the bearing 26 forced into the slightly flared upper extremity of the housing 20. Referring to FIGS. 10 and 11, the lower bearing 24 has its outer surface 27 tapered to conform to the shoulder 23 of the housing. The central opening 28 receives the spindle 25 with freedom for rotation and axial movement. Referring to FIGS. 3 and 4, the top bearing 26 has a tapered side shown at 29 to conform to the flared expansion of the upper extremity of the housing 20. The flange 30 is provided both for appearance, and to limit the forced penetration of the top bearing into the housing. The hole 31 also receives the spindle 25 with freedom of rotation and axial movement.

The upper portion of the spindle 25 is threaded as indicated at 32. In one application of the present invention, the spindle is a solid steel rod one (1) inch in diameter, with a seven (7) threads per inch.

In this embodiment, the preferred thread is an American Standard Stub Acme thread. The conventions of the chair industry have emphasized the usage of the seven (7) threads per inch standard, although modifications of this are certainly consistent with the use of the present invention.

Alternatives to the preferred threads include the use of a six (6) threads per inch design as well as an eight (8) threads per inch design. The eight (8) threads per inch version will understandably have different adjustment characteristics since more turns are necessary to advance or retract a spindle. The opposite is true for the six (6) threads per inch design which will advance and retract with correspondingly less rotation of the spindle. The chair industry as mentioned above, has favored the seven (7) threads per inch specification.

Figure 7:
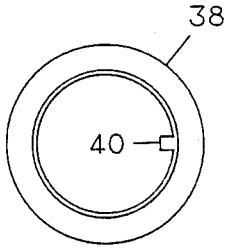
FIG. 7 is a top view of one of the keyed spring washers.
Figure 8:
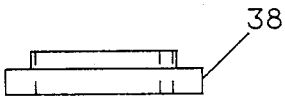
FIG. 8 is a side elevation with respect to FIG. 7.

The length of the threaded portion determines the range of adjustment of the mechanism. The upper extremity of the spindle is provided with a self-locking taper 33 for engagement with a standard socket provided at the underside of the seat (not shown) of the chair. The snap ring 34 engages an appropriate groove in the spindle to limit the downward movement of the spindle with respect to the bearing 26. Just underneath this bearing, the nut 35 is in threaded engagement with the spindle. This nut, and the spindle with it, are biased upwardly by the coiled compression spring 37 acting between the keyway thrust washers 38 and 39. These can both be alike, and are shown in FIGS. 7 and 8. A key shown at 40 engages the keyway 41 of the spindle, so that both of these washers rotate with the spindle. The lower face of the washer 39 transfers the spring force as a thrust bearing to the top transverse surface of the lower spindle bearing 24. The upper surface of the washer 38 is in thrust bearing relationship with the underside of the nut 35. The thrust transferred to the nut 35 urges the upper surface of the nut into engagement with the undersurface of the top bearing 26, and brings the projections 42 and 43 of the nut into engagement with the similarly-shaped recesses 44 and 45 on the bearing. FIG. 1 shows the condition of the components without substantial weight on the seat of the chair. The interengagement of the projections 42 and 43 with the recesses 44 and 45 effectively locks the nut 35 against rotation with respect to the tubular housing 20. While an opposite pair of projections and recesses are shown, a greater number decreases the angle of relative rotation before the clutch engages. Rotation of the seat about the spindle axis can then cause the height of the seat to be adjusted up or down, as a result of relative rotation between the threaded portion of the spindle and the nut 35. During this adjustment, relative rotation takes place between the thrust washer 38 and the nut 35. As soon as weight is placed on the seat, however, the mechanism shifts to the relationship shown in FIG. 2, in which the projections 42 and 43 are disengaged from the recesses 44 and 45. This permits the nut 35 to rotate with the spindle as the occupant of the chair swings from one direction to another, without altering the chair adjustment. During all spindle rotation, relative rotation takes place between the spring washer 39 and the lower bearing 24. The thrust bearing function of these washers can be improved by making them of nylon, or some other low-friction material.

The assembly of this device is the ultimate in manufacturing simplicity. A sub-assembly of the spindle 25, lower bearing 24, spring washer 39, spring 37, upper spring washer 38, nut 35, and upper bearing 26 can be inserted axially into the upper end of the tubular housing 20, with the lower bearing taking a firm seat in the column as a result of its approximate seven and one-half (7 ½) degree taper matching with the portion 23 of the column. The nut 35, of course, has previously been threaded down to the point where the top bearing 26 can assume its assembled position. With the components thus in place, the tubular housing is staked as shown at 46 to secure the assembly in place. The indentations of the staking operation can either be driven into the metal of the top bearing, or a shallow groove can be provided in the periphery of the top bearing opposite the position of the staking. In either case, the result is an interlock which secures the assembled relationship. Other means can be employed to achieve the same function including set screws, roll pinning and other methods known in the art.

With regards to the above mentioned relationships and functions, the following discussion amplifies the underlying functions and modifications that may be employed to achieve specific results. For example, the spring force applied to nut 35 can be selectively adjusted to achieve benefits in the present embodiment that have not been possible in similar mechanisms. Since the present invention allows for a larger spring "envelope" where the envelope is defined by the vertical distance between the thrust washers 38 and 39, the load applied to the spring is then spread or distributed over a spring with a greater number of coils, thereby reducing the torsional stress level of the spring. This advantage is best illustrated in those circumstances where the loading on springs and similar devices is higher than the anticipated average design loading. Under this kind of usage the spring will tend to develop a "set" which diminishes its operating characteristics. This will also affect a change in the clutching capabilities of the adjustment device. It is known that some of these devices have compensated for this effect by increasing the capabilities of the spring or by preloading the spring thereby risking the reverse situation, i.e., where the occupant load is too light and no disengagement of the clutch is allowed to occur. In this circumstance, the movement of the occupant in the chair will cause the spindle to be advanced and retracted through the mechanism.

By increasing the spring envelope, therefore, the life of the spring can be predictably increased as well as allowing a more precise accommodation of load characteristics for particular applications.

In one embodiment, eight and one half (8 ½) coils of 0.177" spring wire are used for generating approximately eighty (80) pounds of support. As is conventional in spring applications, the terminal ends of the spring coil are staggered by one hundred eighty (180) degrees in order to balance the spring action. In the preferred embodiment, 0.218" wire and six and one half (6 ½) coils are used to achieve a higher degree of support. The support in this case would approximate 155 pounds.

By adjusting the amount of spring tension or preload in the chair height adjustment mechanism, the firmness or feel of the seat may be affected. In the case where the occupant sits in a chair incorporating the present invention, the spring tension and the amount of play between the engaged and disengaged positions will cooperate to cushion the actual act of sitting. This creates an illusion of a more cushioned chair which is a perceived advantage to the office chair purchaser as well as the user.

The tubular steel column of the present embodiment accomplishes several objectives. As discussed above, the lower portion of the column 22 has an industry defined taper for insertion into chair base constructions.

This taper is most often a forty (40) millimeter diameter with a 1° 8'46" angular decline in the direction of the bottom of the tubular steel column. The taper thus interlocks with the chair base providing a snug fitting combination that insures chair stability.

Figures 17, 18, 19:
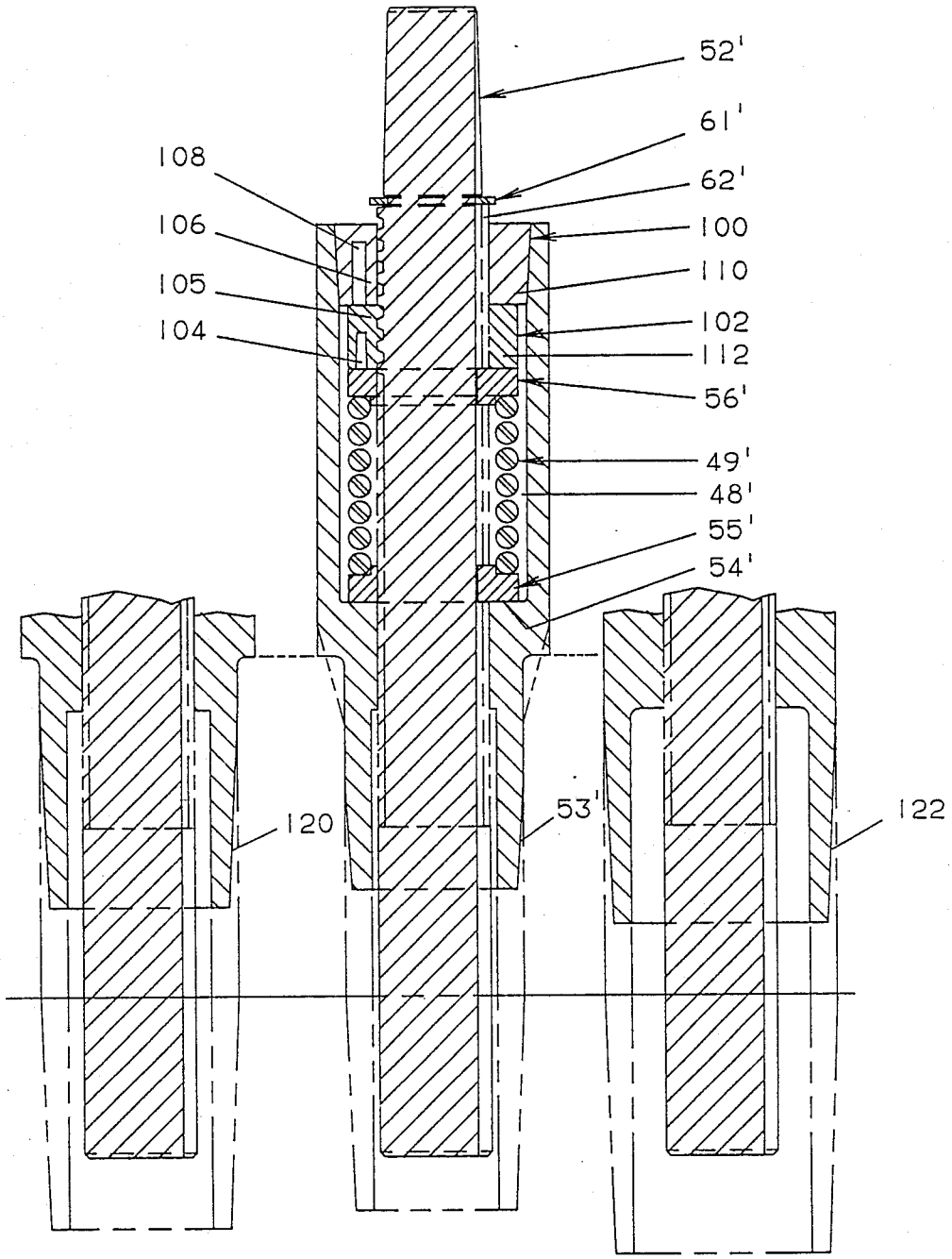
FIG. 17 is a partial side elevation of the second embodiment employing a 45 millimeter taper.
FIG. 18 is a side elevation of the second embodiment employing a 40 millimeter taper.
FIG. 19 is a partial side elevation of the second embodiment employing a 50 millimeter taper.

Alternative tapers are known in the industry which are entirely compatible with the teachings of the present invention. In FIGS. 17 and 19 additional tapers based on a forty-five (45) millimeter tubular column and a fifty (50) millimeter tubular column respectively, are shown in phantom. The forty-five (45) millimeter taper has an angular decline of 2° 35' while the fifty (50) millimeter taper has an angular decline of 1° 26'16".

As is the case in the selection of spindle threads, the industry conventions are based more on historical experiences than on functional attributes. The selection of the various tapers and diameters are really industry selections based on established products. Nonetheless it can be predicted that the forty-five (45) millimeter taper which is usually associated with the die cast chair bases, would facilitate easier removal of the chair base product from the die. Thus at least in that circumstance, there appears to be a functional component to the specification.

Turning now to the midsection of the tubular steel column, the wedging shoulder 23 of the present embodiment is provided by incorporating a taper at this particular point in the steel column itself. The taper is preferentially a seven and one-half (7 ½) degree angle, however tapers may range from as little as approximately three (3) degrees to as great as approximately fifteen (15) degrees. It is noted that the smaller angles or tapers require a greater precision in order to avoid misplacement of the bearing. Slight differences in the outer diameter of the bearing will have a greater effect when the taper is small than when the taper is large.

The larger angles tend to inhibit the creeping tendencies of the lower bearing, thereby more precisely defining the orientation of the bearing components to each other. As a matter of practicality, however, larger tapers are not preferred because they are difficult to produce in the steel column.

The preferential composition of the bearings is nylon. The experiences in using the nylon bearings in a six (6) degree taper indicates that they are resistant to substantial creep. Nonetheless alternative means may be employed to stake or otherwise secure the bearing in place.

Figure 16:
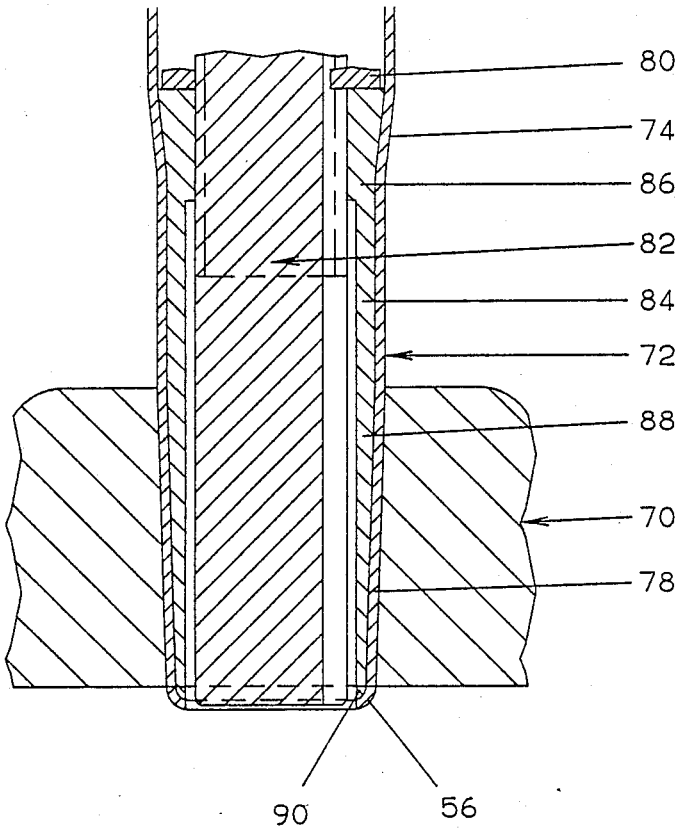
FIG. 16 is a partial side elevation showing a modified form of the first embodiment.

Turning to FIG. 16, a portion of a chair height adjustment mechanism is shown in cross section. In particular, the chair base 70 is shown receiving the tubular steel column 72. As is the case in the previously described embodiment, a lower taper 78 is employed to assist in the seating of the steel column in the chair base. Similarly, other features such as the wedging shoulder 74, the keyway washer 80 and the spindle 82 are in the same relation and are of the same construction as the previously discussed embodiment. The lower bearing 84, however, is extended to the end of the tubular steel column where it meets up with an end flange 56 resulting from the turning in of the taper of the steel column. Specifically, the components of the lower bearing consist of the upper portion 86, the lower bearing extension 88 and the lower bearing end 90.

The modification in FIG. 16 holds the lower bearing in precise orientation with the rest of the components of the chair height adjustment mechanism. Any tendency for the lower bearing to creep is eliminated in this embodiment. In this fashion, the lower bearing may be said to be captured within the steel column of the modification.

In either version, the stability of the lower bearing is sufficient for operation of the chair height adjustment mechanism. In the prior art, the methodology for freezing the lower bearing in the column is typically with set screws, staking by deformation, by roll pinning or by other various means. These all require additional steps or special machining in order to obtain the desired contour to the outer diameter of the taper in the tubular column. With the features of the present invention, these requirements are eliminated as well as reducing the steps necessary for assembly.

The tubular steel column in the present embodiment is preferably 0.060" wall thickness. It has been found that this thickness is compatible with the drawing and forming operations necessary to develop the previously described tapers. The wall thickness may be greater than the 0.060" up to approximately 0.105". Other versions of chair height adjustment mechanisms have relied upon wall thicknesses as great as 0.125" where the lower taper has been subsequently machined to a wall thickness approximating the 0.105" thickness or less in order to insure the proper contour for installation in the chair base. The advantage of the present invention, therefore, allows the usage of thinner and lower cost stock materials that are more easily worked into the required product.

In addition, the usage of the 0.105" stock raises the possibility of using the tubular column support as the hub for the installation of legs for the chair base. It is possible in this circumstance for the legs to be welded directly to the column support of the present invention thereby foregoing the expense of a cast or separately fabricated base component and eliminating the necessity for a tapered column support.

As indicated initially the usage of dual bearings in chair height adjustment mechanisms is a feature that has evolved over time. However, there have been limitation in placement of the bearings which have detracted from their maximum benefit. Ideally the bearings should be placed as far apart vertically as possible. This, plus the additional feature of placing the upper bearing as close to the chair bottom as possible increases the stability and durability of the chair height adjustment mechanism. Related limitations evidenced in other devices have come about as a result of the orientation of the components which have also restricted the amount of stroke that the spindle may realize in a given situation.

Ideally, the stroke for a chair height adjustment mechanism should have a minimum of four (4) inches of travel. In the present invention, four and one half (4 ½) inches is possible. Other devices have compensated for the lack of stroke by allowing additional travel through "stick out". Stick out refers to the amount of spindle that is advanced below the chair base in the lowest chair setting. Stick out is objectionable for the reason it is unsightly and may permit grease or oil to contact carpeting or clothing in the office environment.

Ergonomically, it has been determined that the chair height range of sixteen (16) inches to twenty and one half (20 ½) inches for adjustment is best suited for office chairs. To obtain a four and one half (4 ½) inch stroke within this range without excessive stick out was not possible until the present invention. Many of the other chair height adjustment mechanism operate in the range of seventeen (17) to twenty-one and one half (21 ½) inches in order to compensate for this deficiency.

DESCRIPTION OF THE SECOND EMBODIMENT

Figure 14:
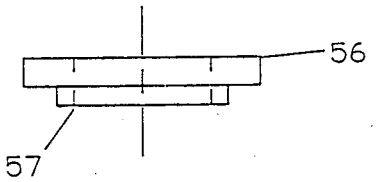
FIG. 14 is a side elevation of one of the spring thrust washers.
Figure 15:
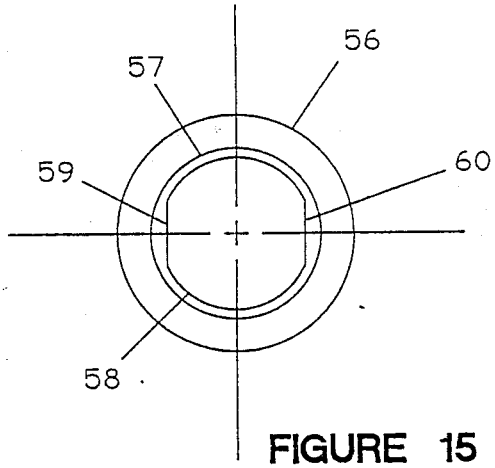
FIG. 15 is a bottom view with respect to FIG. 14.

Referring to FIGS. 12–15, this embodiment of the invention has an integral molded housing 47 that has an upper portion defining a chamber 48 containing a clutch mechanism similar to that illustrated in FIGS. 1 and 2. The remaining components, with the exception of the spring 49 and the spindle 52 can also be molded from plastic or composite materials. The top bearing 50 is pressed, adhesively secured, thermally welded or otherwise secured to the upper end of the housing 47, and rotatably interlocks with the nut 51 through the interengagement of projections and recesses as previously described, depending upon the axial position of the spindle 52 with respect to the housing 47. The housing has a lower portion 53 providing a lower bearing of the system, and the reduction in diameter from that of the chamber 48 to the inside diameter of the lower portion 53 provides the shoulder 54 acting as the thrust bearing transferring the spring forces from the thrust washer 55. The upper thrust washer 56 can be identical, and these are illustrated in FIGS. 14 and 15. The central axial extension 57 locates the spring 49 radially, and the central axial opening 58 has the flat sides 59 and 60 providing non-rotative engagement with the spindle 52. With this arrangement, the spring and the two thrust washers rotate with the spindle at all times, with relative rotation taking place between the lower thrust washer 55 and the shoulder 54. When the nut 51 is axially interengaged with the bearing 50, relative rotation takes place between the nut 51 and the upper thrust washer 56. The lower portion 53 of the housing has a slightly tapered exterior for interengagement with the standard configuration of a chair base, and the periphery of the composite spindle 52 is tapered at its upper extremity for interengagement with the seat structure of the chair. The snap ring 61 is provided to limit the downward movement of the spindle with respect to the housing, as in the FIG. 2 assembly. The spindle threads 62 conform with the desired industry specification. Functionally, the arrangements shown in FIG. 12 and those of FIGS. 1 and 2 are the same.

As can be seen from the above, the second embodiment takes advantages of the properties of plastic in the construction of a chair height adjustment mechanism. The advantages include the ability to mold many of the features directly into the housing 47. The reduction in labor and materials is tremendous and greatly reduces the manufactured cost of the product without altering the function.

The usage of fiberglass impregnated nylon is preferred in the fabrication of the plastic components of the present embodiment. It should be noted at this point that many of the components constructed from plastic can be substituted into the first embodiment of the present invention and vice versa. Dimensional requirements remain essentially the same and the selection of a particular material for fabrication of a washer or nut would be dependent upon the tooling costs, the functional environment, the cosmetic compatibility, and overall cost considerations.

The thrust washer 56 when constructed out of plastic materials is more beneficial than steel in either embodiment. Specifically, the steel washers have the potential for cross threading onto the spindles especially where the metal thickness is one-eighth ($\frac{1}{8}$) inch or less. The chance that the washer in such a case would match up with the corresponding thread with the spindle is increased and damage occurs to both the spindle and the washer in such a situation.

Conversely, with a plastic thrust washer, the washer itself becomes sacrificial to the spindle which is the more costly component. The chance for cross threading can be reduced substantially by increasing the thickness of the plastic thrust washer to three-sixteenths (3/16) inch to one-fourth ($\frac{1}{4}$) inch which reduces the tendency for the washer to be cross threaded. There remains the risk, obviously, of the tendency of the spindle to cut threads into the washer; however, it has been found that this is virtually nonexistent at the preferred thickness of three-sixteenths (3/16) inch or more.

Figure 12:
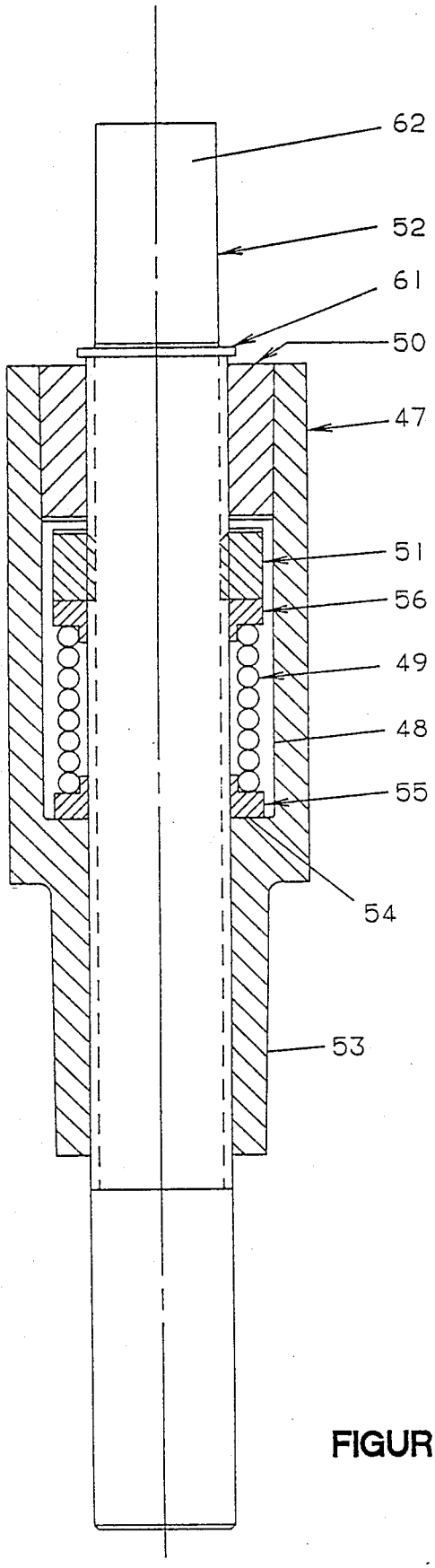
FIG. 12 is an axial section showing a second embodiment of the invention.
Figure 13:
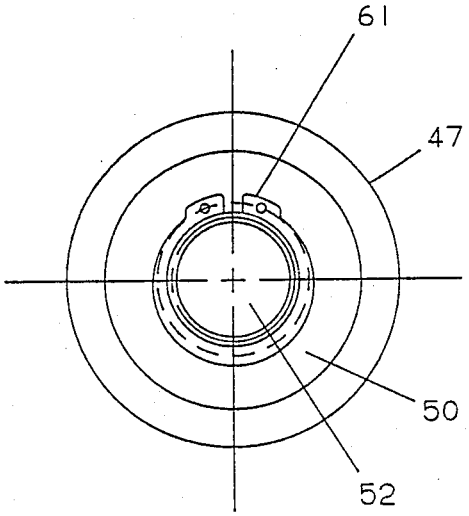
FIG. 13 is a top view with respect to FIG. 12.

Turning now to FIGS. 17, 18, and 19, a slightly modified version of the present embodiment is shown. In particular, the housing 47' is a plastic construction. In accordance with the present embodiment, it is essentially a replicate of the component as shown in FIG. 12 previously. The other components, 48' through 62' are similarly the equivalent of the previously discussed features. In this version, however, the upper bearing 100 and adjust nut 112 have special detent features which are different from the corresponding parts in FIG. 12.

Figure 20:
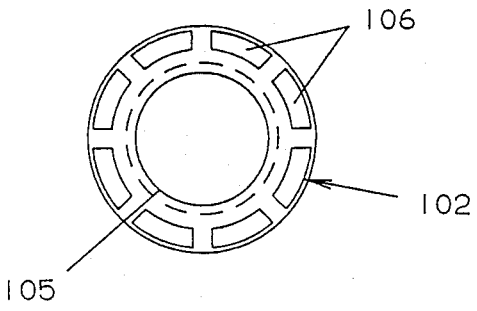
FIG. 20 is a top view of the adjust nut of the second embodiment.

Specifically, on the adjust nut 112, a detent 106 is found on the upper surface and adjust nut web spaces 104 occur in between the adjust nut webs 112. The nut includes thread 105 which corresponds to the threads 62' of the spindle. The adjust nut being constructed of plastic, is preferably made to incorporate a series of radial webs in the injection molded part. As is the case with the upper bearing in FIG. 21, the preferred number of webs is eight (8), leaving eight (8) web spaces as well. The detents as viewed in FIG. 20 are radially oriented and correspond to the web spaces in the upper bearing.

Figure 21:
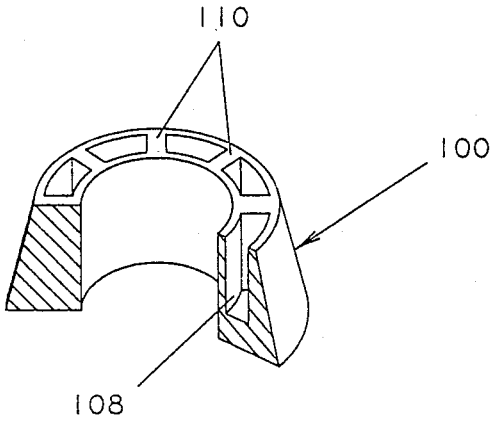
FIG. 21 is an inverted cross sectional view of a modified upper bearing of the second embodiment.

The upper bearing as illustrated in FIG. 21, possesses web spaces 108 and webs 110 as part of its overall plastic construction. The upper bearing, however, has no detents so it differs slightly from the adjust nut in that respect. In contrast to the adjust nut, the webs and web spaces of the upper bearing are functional in the practice of the present invention.

The bearing web spaces 108 occur in substantial alignment with the detents 106 of the adjust nut. In this way, a clutch interface is formed of a more positive nature between the adjust nut and the upper bearing. The positive engagement of eight (8) detents within the corresponding web spaces of the upper bearing affirmatively causes the adjust nut to be held during the chair height adjustment process. Although not shown, the clearance necessary to disengage the adjust nut from the upper bearing must be at least equal to the height of the detent.

From the foregoing description it can be seen that the affirmative engagement between the adjust nut and the upper bearing requires less spring tension to affect the clutching action and torsional force between the detents and the bearing webs is used to affect the actual adjustment. In addition, the spacing of the detents and the webbing is no accident. Aside from the structure integrity the webbing gives to the individual bearing or adjust nut, the spacing in eight (8) segments provides for an immediate initiation of the adjustment. No more than one-eighth ($\frac{1}{8}$) turn is required before actual engagement is made when the load is removed from the chair height adjustment mechanism. This reduces any perceptible slackness in the adjustment mechanism.

Also of some import in this area is the comparison of the adjustment feature to prior devices where additional spring tension is required to cause affirmative engagement between the surfaces of the adjust nut and a bearing surface. In those situations, the spring tension may be high enough so as to require the user of the chair to hold the base immobile while the chair base and spindle are rotated. If this is not done in those devices where the spring tension is high, then rotation of the chair will cause a similar rotation of the swivel base. The sensitivity of the design factors in the present embodiment is therefore reduced since stabilization of the adjustment nut occurs in cooperation with the torsional resistance of the stationary upper bearing. Therefore a wide range of spring tension is available for use in the present invention without detracting from the ultimate objectives.

The foregoing represents various ways and methods of practicing the present invention and is not as such a limitation. The embodiments may be modified or varied by those skilled in the art without detracting from the spirit and scope of the present invention.

I claim:

1. A height-adjustment mechanism for a chair, said mechanism including a housing, a threaded spindle, radial bearing means positioning said spindle on a normally vertical axis in said housing, a nut in threaded engagement with said spindle, a compression spring normally below said nut and surrounding said spindle, thrust bearing means in said housing below and supporting said spring, and clutch means adapted to rotatively fix said nut with respect to said housing under the action of said spring, and to release said nut for rotation with said spindle in response to downward movement of said spindle, wherein the improvement comprises:

an upper bearing constituting one of said radial bearing means, said upper bearing being secured above the nut to the upper extremity of said housing, and putting closely over said threaded spindle such that said spindle has freedom of axial and rotational movement but is restrained by said upper bearing from lateral movement, said clutch means being provided by axial interengagement of said nut and a member fixed with respect to said housing above said nut.

2. A mechanism as defined in claim 1, wherein said member is said upper radial bearing.

3. A mechanism as defined in claim 2, wherein said nut and upper radial bearing have axially interengageable surfaces providing engageable projections and recesses.

4. A mechanism as defined in claim 1, wherein said housing is an integral tubular member, the diameter of the upper portion of said tubular member being increased over that of the lower portion thereof providing an offset supporting a lower radial bearing of said radial bearing means, said upper portion defining a chamber receiving said spring and nut.

5. A mechanism as defined in claim 4, additionally including a pair of spring thrust washers rotatively fixed with respect to said spindle, one of said washers being interposed between said spring and said nut, and the other thereof between said spring and said lower radial bearing for relative rotation and thrust transfer.

6. A mechanism as defined in claim 5, wherein said spindle has a pair of opposite flat sides on said threaded porion, and said thrustwashers have central apertures closely receiving both of said flat sides.

7. A mechanism as defined in claim 1, wherein said housing has an upper portion providing a chamber receiving said nut and spring, and a lower portion providing a lower bearing constituting one of said radial bearing means, said housing having a shoulder at the lower extremity of said chamber providing said thrust bearing means.

8. A mechanism as defined in claim 7, wherein said housing is an integrally molded piece, and said lower portion providing said lower bearing additionally provides a projection engageable on its outer surface with a chair base structure.

9. In a height adjustment mechanism for a chair, wherein the chair includes a base and a seat, with the height adjustment mechanism extending between the base and the seat to support the seat on the base at adjustable heights above the base, the seat height being adjusted by rotation of the seat with respect to the base when the seat is unoccupied, the height of the seat being non-adjustable by rotating the seat with respect to the base when the seat is occupied, the improvement wherein the height adjustment mechanism comprises:

an elongated housing having an open interior adapted to be fixed to the base at a lower end so as to extend upwardly therefrom to an open upper end that is adjacent the seat when the seat is adjusted to its lowermost position;

a spindle adapted to be fixed to the seat so as to extend downwardly therefrom into the interior of the housing, the spindle having a threaded portion extending inside the housing;

an upper bearing non-rotatably mounted above the nut in the upper end of the housing, the upper bearing having an opening therethrough that fits closely over the spindle, the upper bearing permitting axial and rotational movement of the spindle therethrough but restraining the spindle against lateral movement with respect to the housing;

a lower bearing that is non-rotatably mounted in the housing at a lower portion thereof, the lower bearing being axially spaced apart from the upper bearing, the lower bearing permitting axial and rotational movement of the spindle therethrough but restraining the spindle against lateral movement with respect to the housing, the upper and lower bearings serving to hold the spindle in a substantially vertical position and to resist lateral forces applied thereto;

a nut threaded on the spindle between the upper and lower bearings;

resilient biasing means mounted inside the housing for urging the nut upwardly with respect to the housing, the nut and attached spindle being movable to an upper position under urging of the biasing means when the seat is unoccupied and moving down to a lower position against the urging of the biasing means when the seat is occupied; and clutch means mounted in a fixed position in the housing and being engaged with the nut when the nut is in its upper position so as to cause the nut to remain in a fixed position with respect to the housing when the spindle is rotated, thereby raising the seat by causing axial movement of the spindle with respect to the nut and housing, the clutch means being disengaged from the nut when the nut is in its lower position, wherein the clutch means does not prevent the nut from rotation with the spindle when the spindle rotates in the housing, thereby permitting spindle rotation without axial movement in the housing.

10. A height adjustment mechanism according to claim 9 wherein the clutch means comprises a lower surface on the upper bearing and an upper surface on the nut, the two surfaces being positioned opposite each other and being engaged together when the nut is in its upper position, the opposed surfaces having raised portions and recesses that fit together so as to resist relative rotation therebetween when the surfaces are resiliently urged into engagement with one another.

11. A height adjustment mechanism according to claim 9 wherein the resilient biasing means comprises a compression spring positioned in the housing between the spindle and the housing and further comprising an upper washer abutting the upper end of the spring, the washer receiving the force of the spring, the washer being mounted on the spindle so as to be non-rotatable on the spindle but axially movable on the spindle, rotation of the spindle thus causing rotation of the washer, the upper washer being positioned adjacent the underside of the nut, the spring resiliently urging the upper washer into frictional engagement with the nut, such that rotation of the spindle in the housing urges the nut to rotate with the spindle, the clutch means providing a greater rotational stopping force on the nut than the rotation urging force of the upper washer when the clutch is engaged.

12. A height adjustment mechanism according to claim 11 wherein the spring is partially compressed when the clutch means is engaged with the nut and becomes more compressed when the clutch means becomes disengaged from the nut by an occupant sitting on the seat, such that the spring provides a resilient cushioning support for the occupant while seated.

13. A height adjustment mechanism according to claim 9 wherein the resilient biasing means comprises a compression spring positioned between a lower side of the nut and an upper surface of the lower bearing, a washer being positioned between an upper end of the spring and a lower surface of the nut and a washer being positioned between a lower end of the spring and the upper surface of the lower bearing, the washers being non-rotatably mounted on the spindle but being axially movable thereon, the spring exerting a resilient upward supporting force between the lower bearing and the nut through the washers, the engagement of the washers with the spring serving to urge the spring to rotate with the spindle and washers without rotational friction between the ends of the spring and the washers.

14. A height adjustment mechanism according to claim 13 wherein the spindle has at least one side that is at least partially flattened, the washers having portions that fit against the flattened portion of the spindle so as to make the washers non-rotatable on the spindle.

15. A height adjustment mechanism according to claim 13 wherein the washers are at least 3/16 inches thick, and that they do not slide sideways into driving engagement with the threads on the spindle.

16. A height adjustment mechanism according to claim 13 wherein the washers and bearings are formed of a synthetic resin.

17. In a chair height adjusting mechanism having a lower end operably installed in a chair pedestal and a upper end non-rotatably secured to a chair seat, said chair height adjusting mechanism including a elongated housing with an open interior, a vertically elongated threaded spindle extending through said housing, the spindle being non-rotatably secured at an upper end thereof to the chair seat, the chair height adjusting mechanism rotatably supporting the chair seat without height adjustment when occupied, the chair height adjusting mechanism being vertically adjustable when the seat is unoccupied, such adjustment being effective by rotation of the chair seat with respect to the pedestal, the chair height adjusting mechanism further including a nut in threaded engagement with the spindle, a compression spring surrounding the spindle, a bearing means surrounding the spindle and a clutch means adapted to rotatively fix the nut with respect to the housing and to release the nut for rotation with the spindle in response to downward loading of the spindle, wherein the improvement comprises:

a bearing means with an upper radial bearing mounted above the nut at an upper portion of the housing and a lower radial bearing spaced below the nut and apart from the upper bearing and being supportably retained within a lower portion of the housing, both bearings fitting closely over the threaded spindle with freedom of axial and rotational movement; and upper and lower washers disposed between the nut and the lower bearing and enclosing the compression spring therebetween, the spring, the washers and the nut tending to rotate with the spindle in the occupied state, the lower washer being supported by the lower bearing and the upper washer being upwardly biased against the nut by the compression spring, such bias being sufficient to bring the upper washer into direct engagement with the nut in the unoccupied state, the upwardly biased upper washer translating the bias through the nut and to the spindle causing the nut to resiliently engage the upper bearing, such engagement restraining the nut against rotation with respect to the housing when the seat is unoccupied, thereby permitting advancement of the threaded portion of the spindle through the nut by rotation of the spindle.

18. A chair height adjusting mechanism as in claim 17, where the washers are keyed in cooperation with a keyway in the spindle, affirmatively rotating the washers in response to rotation of the spindle.

19. A chair height adjusting mechanism as in claim 17, wherein the spindle has at least one longitudinal flat surface and the washers have at least one corresponding flat surface on the portion of the washers surrounding the spindle, the combination causing the washers to affirmatively rotate in response to rotation of the spindle.

20. A chair height adjusting mechanism as in claim 17, wherein the upper bearing is positioned at the top of the housing.

21. A chair height adjusting mechanism as in claim 17, wherein the lower bearing is positioned as far below the upper bearing as possible without permitting the spindle to become disengaged from the lower bearing when raised to its highest position.

22. A chair height adjusting mechanism as in claim 17, wherein the clutch means comprises an upper surface of the nut and a lower surface on the upper bearing, the surfaces including interfitting projections and recesses that cause non-rotational engagement of the nut with the upper bearing when the surfaces are resiliently engaged.

* * * * *

UNITED STATES PATENT AND TRADEMARK OFFICE

CERTIFICATE OF CORRECTION

PATENT NO. : 4,903,930

DATED : 02-27-90

INVENTOR(S) : James M. Jann

It is certified that error appears in the above-identified patent and that said Letters Patent is hereby corrected as shown below:

Claim 1, column 9, line 41, delete "putting" and substitute --fitting--;

Claim 6, column 10, line 1, delete "porion," and substitute --portion,--;

column 10, line 1, delete "thrustwashers" and substitute --thrust washers--;

Claim 17, column 11, line 65, delete second occurrence "a" and substitute --an--; and column 11, line 67, delete "a" and substitute --an--.

Signed and Sealed this

Sixteenth Day of April, 1991

*Attest:*

*Attesting Officer*

HARRY F. MANBECK, JR.

*Commissioner of Patents and Trademarks*